US006164635A

United States Patent [19]

Chase et al.

[11] Patent Number: 6,164,635

[45] Date of Patent: Dec. 26, 2000

[54] MILLING MACHINE BENCH VISE

[76] Inventors: Donald Chase; Russell Chase, both of 6626 Guhn, Houston, Tex. 77040

[21] Appl. No.: 09/316,345

[22] Filed: May 21, 1999

[51] Int. Cl.[7] ..... B25B 1/10

[52] U.S. Cl. ..... 269/244; 269/136

[58] Field of Search ..... 269/136, 138

[56] References Cited

U.S. PATENT DOCUMENTS

| | | | |
|---|---|---|---|
| 4,738,438 | 4/1988 | Horie et al. | 269/244 |
| 4,928,937 | 5/1990 | Bernstein | 269/138 |
| 4,934,676 | 6/1990 | Feistenauer et al. | 269/136 |
| 5,273,264 | 12/1993 | Chen | 269/136 |

*Primary Examiner*—David A. Scherbel
*Assistant Examiner*—Daniel G. Shanley
*Attorney, Agent, or Firm*—Felsman, Bradley, Vaden, Gunter & Dillon, LLP

[57] ABSTRACT

An improved vise with a fixed jaw and a movable jaw which is guided by a lead screw to move along a pair of ways guiding the movable jaw. The movable jaw is adjusted to maintain a face which is precisely parallel with a face of the fixed jaw. The movable jaw is constructed of an upper component which travels on the ways, and a U-shaped lower member which inserts and telescopes into the upper component. The two jaw members contact at a chamfered face which cants or tilts the upper jaw member so that the movable jaw construction can be leveled. Leveling assures that the upper and lower jaw members cooperate, thereby interacting with a tapered face between the two to change the relative angle. In effect, the movable jaw face is maintaining precisely parallel and overcomes off center mounting of a workpiece.

20 Claims, 3 Drawing Sheets

MILLING MACHINE BENCH VISE

BACKGROUND OF THE DISCLOSURE

A bench vise is used in holding a workpiece for manufacturing. Such a workpiece must be gripped in some manner and held steadily to the cutting head of a milling machine. It is especially important that the workpiece be held consistently especially when manufacturing the same product time and time again. Consider for instance a long production run of 1,000 units. Adjustments are made in the milling machine to locate the cutting head with respect to the table and to program moves of the cutting head with respect to the first workpiece. All of this requires repetitive and precision attachment to the workpiece temporarily to the table of the milling machine. The milling machine table normally supports a bench vise on it. The vise is opened and then closed to clamp on a workpiece. The accuracy of the programmed movements as well as the accuracy of the finished product is in large part dependent on the accuracy of the workpiece with respect to the milling machine. In turn, if the milling machine starts at the wrong position with respect to the workpiece, it will finish at the wrong position. Repeatable positioning is essential.

The most reliable mode of operation of the equipment is therefore dependent on accuracy in positioning with respect to the vise. Accuracy in the use of the vise is extremely important. The vise is normally constructed so that clamping a workpiece between the two jaws of the vise encounters a measure of variation. The risk a is dependent on accurate tracking of the vise as it is opened and closed. In many vise constructions, the vise will work quite well when the workpiece is centered with respect to a centerline axis of the vise, i.e., an axis defined by the screw which opens or closes the jaws. While the jaws might have a relatively large surface, when the workpiece is off center, the jaws may cant ever so slightly. In effect, the faces defining the two jaws will no longer be positioned in a parallel fashion. In other words, the movable jaw may be canted with respect to the fixed jaw and create a misalignment which is not necessarily seen by the eye but which derives from improper operation of the jaws of the vise during movement.

In one aspect, the workpiece held by the jaws of a vise in accordance with the present disclosure can be off center and yet not cant or cock the jaws inappropriately. In another aspect, the workpiece is gripped by the movable jaw so that off center gripping does not jeopardize proper jaw operation. Specifically, the device closes in such a fashion that misalignment does not occur. This is accomplished by constructing the movable jaw so that it travels on left and right ways. It will not cant or otherwise wedge. This avoids wedging difficulties. This assures continued alignment of the device when grasping a workpiece between the two jaws. The movable jaw is constructed with a way gripping lower surface. The jaws include a tapered or sloping surface. This repositions so that the jaws track true to the centerline axis, i.e., the jaw face is precisely vertical.

The present disclosure is an improved vise featuring a movable jaw which is guided by a screw to move along a pair of ways guiding the moving jaw. The moving jaw is adjusted to maintain a face which is precisely parallel with the fixed jaw face. The moving jaw is constructed of an upper component which travels on the ways. It is, however, internally hollow so that a U-shaped lower member inserts into it, the insert being a U-shaped bottom member telescoped into a U-shaped mating opening in the top jaw member. The two jaw members contact at a tapered face which cants or tilts the upper jaw member so that the movable jaw construction can be leveled. Leveling assures that the upper and lower jaw members cooperate, thereby interacting with a tapered face between the two to change the relative angle. In effect, the movable jaw face is maintaining precisely parallel and overcomes off center mounting of the workpiece.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE FIRST EMBODIMENT

Figure 1:
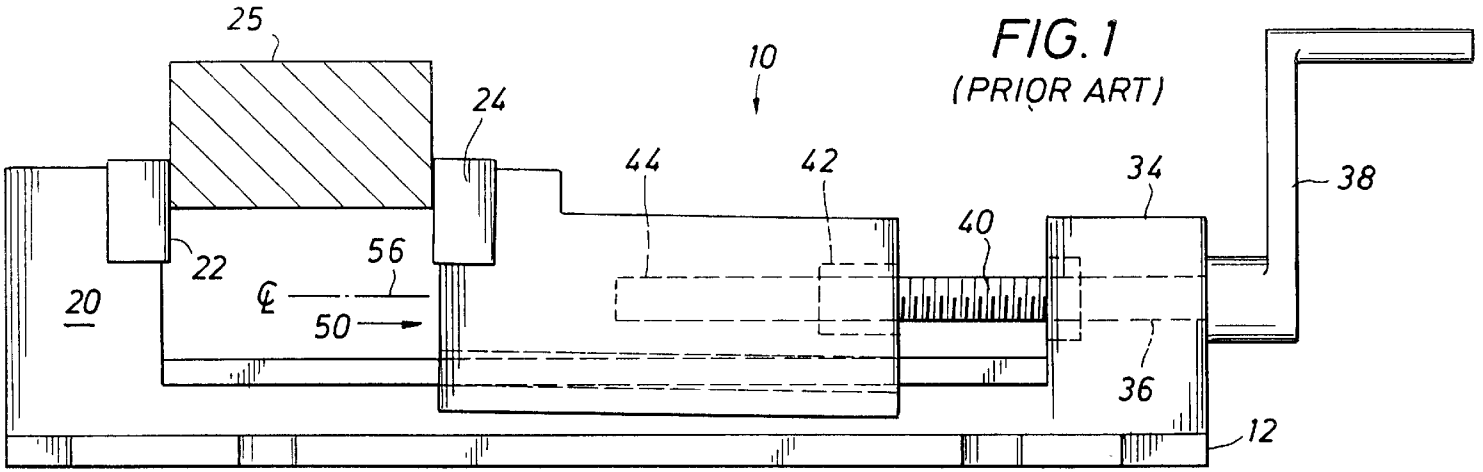
FIG. 1 (PRIOR ART)
FIG. 1 is a side view of a prior art milling machine bench vise showing off center mounting of a workpiece which causes canting, tilting the jaw face upwardly.
Figure 2:
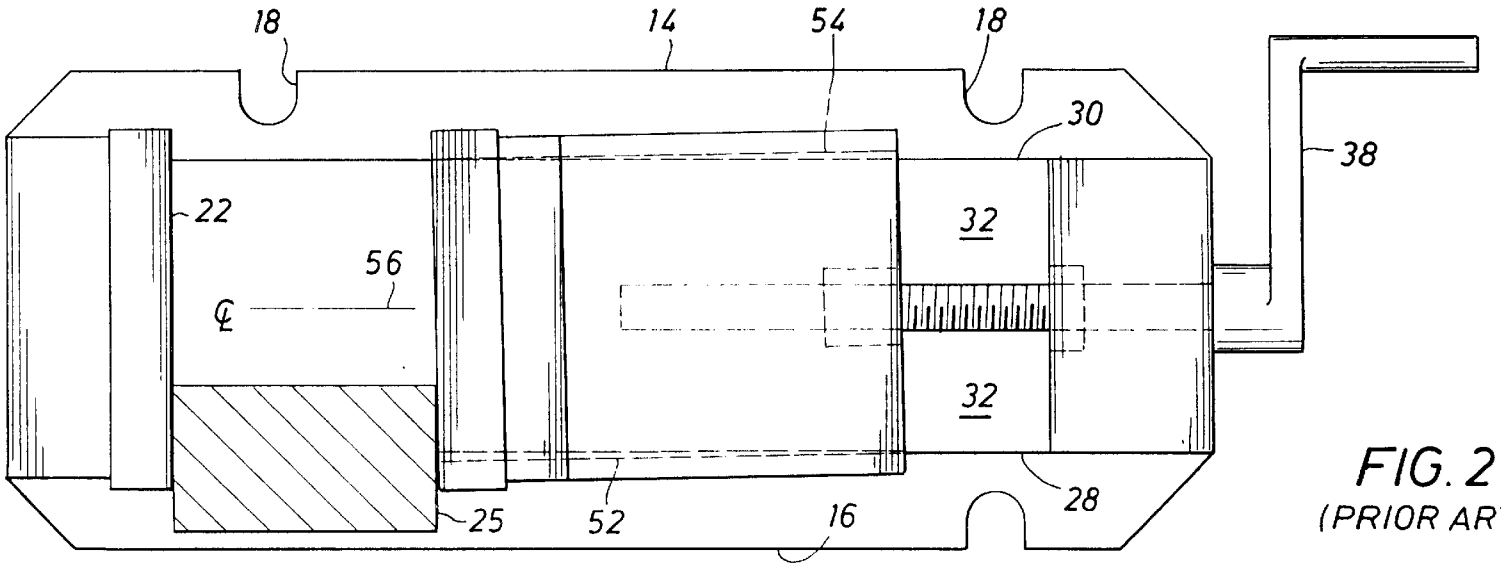
FIG. 2 (PRIOR ART)
FIG. 2 is a plan view of the prior art milling machine bench vise showing off center mounting of the workpiece canting the jaws by inserting a workpiece to the side of the centerline axis.

In setting forth the description of the bench vise of this disclosure, it is helpful to begin with the description of a prior art bench vise. After that description has been completed, the bench vise of the present disclosure will then be described in significant detail. This will help provide a measure of contrast and illustrate how the present embodiment operates. To accomplish this description, the prior art bench vise is shown in FIGS. 1 and 2 considered jointly and is identified generally by the numeral 10. It is constructed with a base plate 12 which has marginal protruding edges 14 and 16 which are notched at appropriate locations 18 to enable the bench vise to be bolted to the working table of a milling machine. At the distal end, the base plate 12 supports an upstanding fixed jaw 20. The jaw 20 has a vertical face 22. The vertical face provides a registration surface. It is common to substitute a removable insert for replacement of the vertical face. Thus, the reference numeral 22 refers in particular to an insert which can be added or replaced. Inserts of this sort are necessary to enable a gripping surface to be provided for different types or shapes of workpieces. Typically, the insert 22 is matched to the opposing insert 24. Again, it provides the vertical face on the movable jaw which will be described in detail. The two inserts 22 and 24 (both having facing surfaces which define the workpiece registration surfaces) are shown clamping a workpiece 25. The workpiece 25 is shown in FIG. 1 at a raised location. This often is necessary because of the contours of the workpiece. The key aspect of the workpiece shown in FIG. 1 is that it is above the centerline axis of the bench vise. It is above so that it is not in line with the screw moving the movable jaw as will be described.

Figure 4:
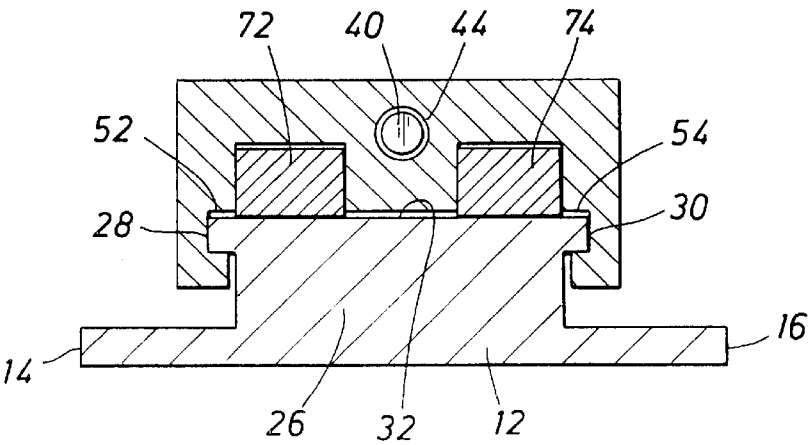
FIG. 4 is a sectional view through the bench vise along the line 4—4 showing the upper and lower movable jaw components and the relative support on the ways for movement.

The fixed jaw 20 is located at the end of a set of ways. The ways are better shown going momentarily to FIG. 4 of the drawings. FIG. 4 shows the base plate 12 and the edge located overhanging edges 14 and 16 which are constructed in an integral fashion. The central body of the base is generally identified as the region 26, and is constructed with edge located overhanging left and right ways 28 and 30. They overhang on both sides to enable a grip to be obtained. The grip secures the movable jaw for travel on the top surface 32 better shown in the plan view of FIG. 2. The surface 32 will be described afterwards as the guide surface for movement. The guide surface supports the movable jaw on it. The jaw is pulled down toward the guide surface by the overhanging construction of the movable jaw relative to the edge located ways 28 and 30. The problem of canting will be detailed later.

At the right hand end, an upstanding fixed block 34 is provided with a drilled hole 36 to enable a rotatable crank 38 to be turned for rotation. The shaft of the crank extends through the opening 36, and has no threads so that it is free to rotate endlessly in either direction with regard to the mounting block 34. The shaft however is threaded to define the lead screw 40 which prompts relative motion. The lead screw 40 extends into an internally threaded nut 42. The traveling nut is immediately adjacent to an elongate hollow passage 44 to receive and hold the lead screw 40. The lead screw 40 has a length such that it extends into the passage 44 without bottoming in that passage. It is free to rotate without contact against the side wall of the passage 44. However, it threadedly engages the traveling nut 42. The lead screw rotation prompts the traveling nut to move to the left or right as viewed in the drawings dependent on the rotation of the crank 38. Rotation of the crank prompts this motion. When the motion occurs, the movable jaw is moved toward the fixed jaw.

The entire jaw assembly is generally identified by the numeral 50. The jaw assembly 50 is locked on the ways 28 and 30. As shown in FIG. 4, the ways have a finite and relatively uniform thickness and protrude into a pair of slots which are somewhat oversized. The slots are constructed so that they enable the ways to be grasped by the movable jaw. As illustrated in FIGS. 1 and 2, there is a certain measure of clearance in the two slots 52 and 54 which grasp the ways 28 and 30. The slots 52 and 54 are shown in both FIGS. 1 and 2 slightly canted as a result of the off center mounting of the workpiece 25. More specifically, the centerline axis is shown extended from the lead screw 40 which defines the center of the movable jaw. In both instances, the workpiece 25 is shown at an offset location with respect to the centerline; this prompts the jaw to cant or tilt with respect to the centerline axis when the workpiece is mounted in an off center location. The measure of canting may be slight, but it is cause for difficulty in operation of the bench vise. More especially, the way slots 52 and 54 are shown in dotted line in FIGS. 1 and 2 to illustrate how the movable jaw will accommodate the workpiece offset mounting to thereby create difficulties. These difficulties derive from the accommodation of the way slots with the ways so that the movable jaw 50 ultimately is dislodged from a perfectly parallel position between the inserts 22 and 24.

Improved Bench Vise Description

Figure 3:
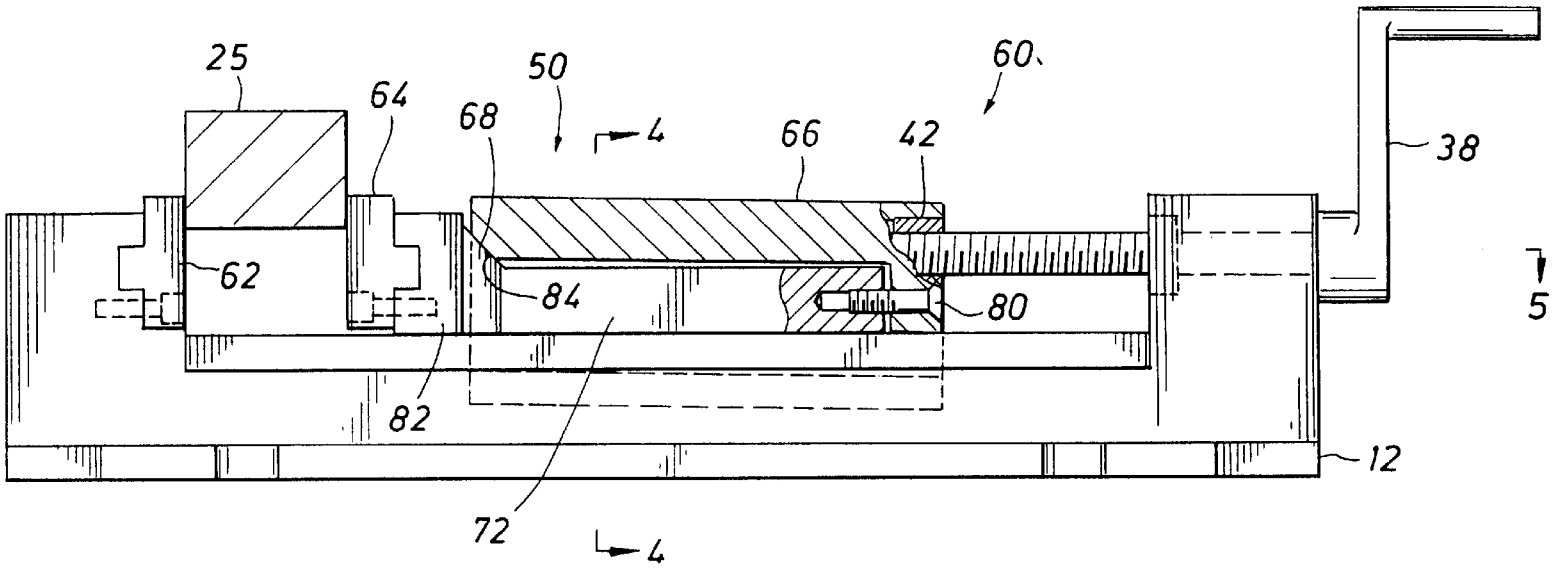
FIG. 3 is a sectional view through the milling machine bench vise of the present disclosure showing a moving jaw formed of two components which contact at a tapered surface to change canting angles to overcome off center mounting of the workpiece.

Attention is now directed to FIG. 3 of the drawings where the improved bench vise 60 is illustrated. Reference numerals from the embodiment 10 have been incorporated in this particular version of the bench vise. The improved version, however, brings certain features which modify the movable jaw 50 so that it maintains a parallel position for the two jaw faces. Beginning with the jaw faces, FIG. 3 shows a sacrificial pair of jaw inserts 62 and 64 which are grasping an off center workpiece 25. They are deployed for installation and subsequent removal. Again, it is not unusual to use entirely different inserts for different workpieces depending on the grip required for the workpieces. In this particular instance, the movable jaw is significantly different from that shown in FIG. 1 of the drawings. The movable jaw of the present disclosure is constructed with two major components. The movable jaw system of FIG. 3 is constructed with a top piece 66 which supports the traveling nut 42 at one end and which terminates at a chamfered face 68 at the jaw end. As shown in FIG. 4 of the drawings, it is constructed with the way slots 52 and 54. They are disposed for gripping on the marginal edges of the guide surface 32. The guide surface 32 is shown in FIG. 4 under and therefore guiding the upper jaw piece 66. Nevertheless, the jaw piece 66 does not rest directly on the guide surface 32. It is forced upwardly so that the way slots 52 and 54 are pulled against the ways 28 and 30 and slides against them on the nether side. The nether side connection is defined in FIG. 4 where the slots grasp around the ways, thereby enabling pull to be applied while raising the upper jaw piece 66. The upper jaw piece 66 is located above a lower jaw piece 70. The jaw piece 70 is a U-shaped member having similar guide legs 72 and 74 shown in FIG. 5 of the drawings. The two legs 72 and 74 actually contact the guide surface 32, see FIG. 4. The legs are sized to fit into matching receptacles formed in the upper jaw piece 66. The receptacles 76 and 78 are hollow, approximately rectangular in cross-section as shown in FIG. 4, and are open on the bottom side so that the bottom jaw piece 70 extends out of the two cavities and into contact with the guide surface 32. The two receptacles terminate near the right hand end of the upper jaw piece 66. Recessed openings are provided for adjustment screws 80 which are threaded into the appropriate openings and which threadedly engage internally tapped openings in the parallel members 72 and 74. Relative movement of the lower jaw piece 70 to the right or left is controlled by adjustment of the pair of screws 80. It should be understood that different arrangements for the adjusting screws could be employed, comprising a single screw or more than two screws, in order to obtain the desired relative movement of the lower jaw piece 70.

Going now to FIG. 3, the lower jaw piece 70 is constructed with a transverse head 82 which is at right angles with respect to the two parallel guide legs 72 and 74. The head is constructed with a chamfered or tapered surface 84 which matches the angle of the overhanging tapered surface 68 thereabove. The transverse head is of substantial thickness and has a conforming alignment slot for the jaw inserts 62 and 64, one being mounted on the transverse head. The transverse head is able to slide on the guide surface 32. The transverse head in conjunction with the parallel guide legs 72 and 74 defines a U-shaped member which is moved into the receptacles under the control of the adjustment screws 80. Adjustment of the screws 80 pulls the top sloping surface 84 farther into the receptacle in the movable upper jaw piece 66, thereby canting or tilting it as shown in dotted line in FIG. 3. This tilt accommodates the grasp of the upper jaw piece 66 on the ways 28 and 30. As shown, the piece 66 tilts or cants upwardly. Even though it may tilt, and such tilt may be the inevitable result of providing some clearance in the slots, the lower piece does not tilt or cant. The movable jaw is constructed so that it stays smoothly on the guide surface 32 so that the face of the movable jaw is at right angles with the guide surface 32. It stays at right angles even when the workpiece 25 is mounted off center as shown in FIG. 3.

Figure 5:
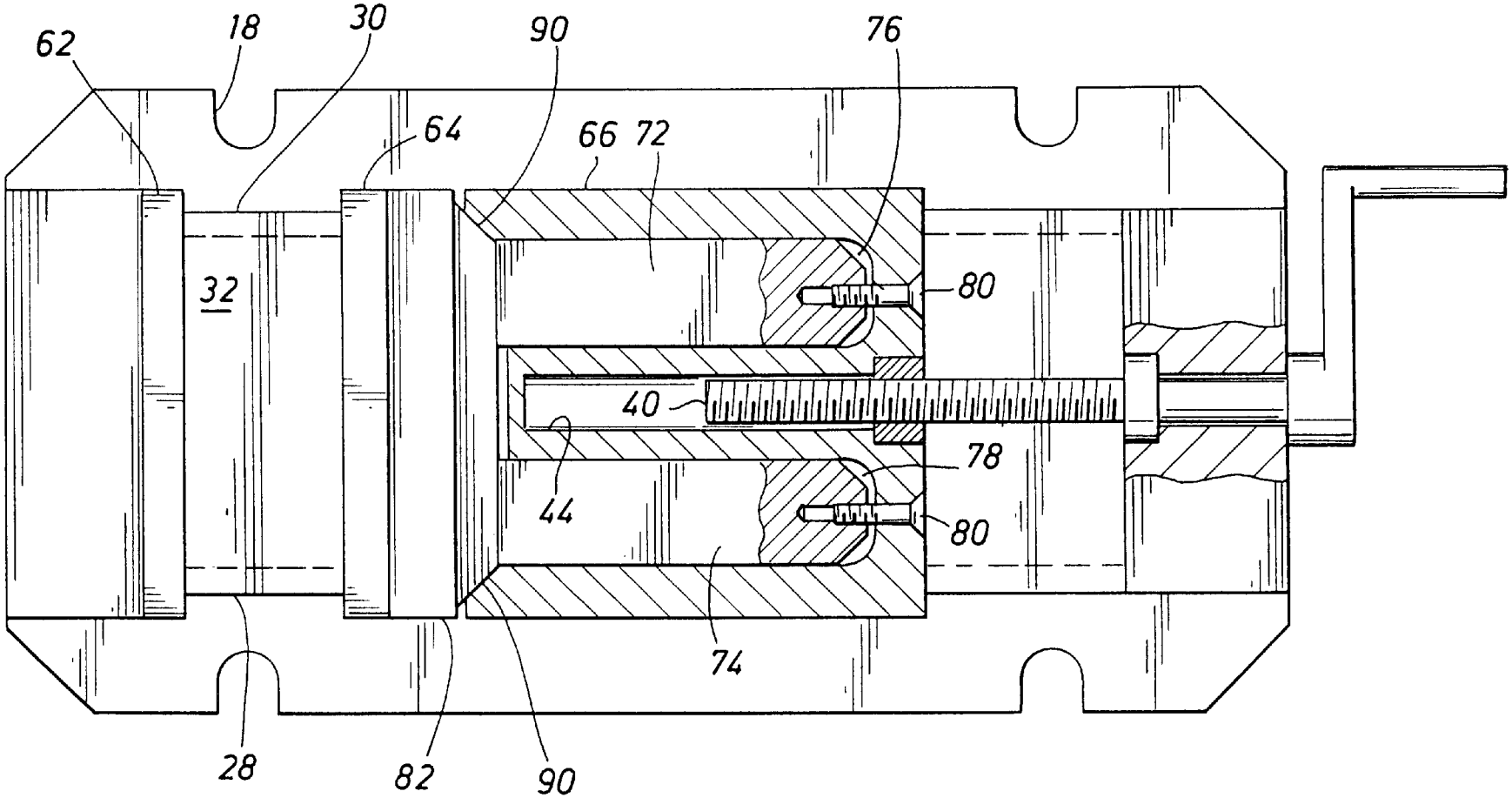
FIG. 5 is a plan view similar to FIG. 2 showing details of internal construction of the movable jaw in which the upper and lower pieces have been broken away and are shown in sectional view to provide details of construction.

This construction is shown more completely in FIG. 5 of the drawings. There, the upper jaw piece 66 is illustrated with the transverse jaw head 82 inserted against the tapered matching faces 68 and 84 (best shown in FIG. 3) and FIG. 5 shows the head in the receptacle in the upper jaw piece 66. The jaw piece 66 is open at the left hand end so that the lower jaw piece 70 can insert into it. The thick wall construction around the two receptacles 76 and 78 terminates at a sloping surface 90 which is symmetrically shown at both marginal edges in contact with the transverse head piece. The head is constructed with a mating or conforming tapered face shown in the plan view of FIG. 5. That construction is useful to align the head 82 so that it is perpendicular to the centerline which is defined by the lead screw 40. In other words, the head seats against the tapered faces 90 when pulled to the right as shown in FIG. 5 responsive to tightening of the screws 80. In summary, this assures that the head is held at right angles.

Movement of the upper jaw piece 66 to cant upwardly at the left (see FIG. 3) is accommodated even though the surface 90 is pressed against the transverse head. So to speak, the upper jaw piece 66 can ride up and over the lower jaw piece 70 dependent on the wedging action of the cooperative tapered faces 68 and 84. That movement is by operation of the two jaw pieces. If they are moved apart, the upper jaw piece can move downwardly away from the canted position shown in dotted line in FIG. 3. When they are pulled together by the screws 80, the movement prompts the overriding motion and rotation of the upper jaw piece.

Operation of the present invention is routinely accomplished for thousands of operations in opening and closing of the jaws. When the workpiece 25 is off center and there is any risk of canting, the upper and lower jaw pieces 66 and 70 are relatively adjusted to the required new position. This prompts the upper jaw piece to cant upwardly and yet force the lower jaw piece 70 downwardly against the guide surface 32. Proper guidance of the lower jaw piece is assured even though the workpiece is off centered. The only motion that occurs between the upper and lower jaw pieces is the relative motion accompanied by sliding at the tapered surfaces. The way slots, change the normal forces to the guide surface 32, but that poses no particular problems because motion of the lower jaw on it can be smooth simply by adding lubricant to that surface as desired. As wear occurs, relative motion by periodic adjustment overcomes wearing.

While the foregoing is directed to the preferred embodiment, the scope thereafter is determined by the claims which follow.

What is claimed is:

1. A milling machine vise for gripping a workpiece, comprising:

(a) a base comprising
  (i) a fixed jaw face supported at a fixed jaw end,
  (ii) a mounting block supported at a second end,
  (iii) a glide surface between said fixed jaw end and said second end, and
  (iv) left and right ways bordering parallel sides of said glide surface; and (b) a movable jaw comprising
  (i) an upper jaw piece supporting a traveling nut at a crank end and forming orthogonal, chamfered faces at a moving jaw end, and having edge located slots extending from said moving jaw end to said crank end and which engage said left and right ways,
  (ii) a U-shaped lower jaw piece having parallel left and right legs fitting into hollow receptacles in said upper jaw piece, and having a traverse head at right angles to said left and right legs, and forming a moving jaw face, and
  (iii) two adjusting screws threaded into openings in said crank end of said upper jaw piece and threadedly engaging internal tapped openings in said parallel legs; wherein (c) said orthogonal, chamfered faces on said upper jaw piece contact matching orthogonal, chamfered faces on said traverse head of said lower jaw piece thereby allowing relative motion of said upper jaw piece with respect to said lower jaw piece to be controlled by adjusting said screws, and thereby allowing said upper jaw piece to cant within said ways while said lower jaw piece remains in contact with said glide surface thereby maintaining said fixed jaw face and said moving jaw face parallel when gripping said workpiece displaced from a center line of said vise.

2. The vise of claim 1 further comprising:

(a) a rotatable crank with a shaft extending through an opening in said mounting block; and (b) a lead screw operationally attached to said shaft and threaded into said traveling nut; wherein (c) rotation of said crank moves said movable jaw with respect to said fixed jaw.

3. The vise of claim 2 further comprising:

(a) a first sacrificial insert affixed to said fixed jaw face; and (b) a second sacrificial insert affixed to said moving jaw face; wherein said inserts aid in gripping said workpiece when grasped between said jaw faces off center from said center line of said vise.

4. The vise of claim 2 wherein said screws are periodically adjusted to compensate for wear of said ways, said edge located slots and said glide surface thereby maintaining contact between said parallel legs and said glide surface when said workpiece s gripped off center from said center line of said vise.

5. The vise of claim 2 wherein said center line is defined by the major axis of said lead screw.

6. The vise of claim 2 further comprising notches in said base with which said vise is bolted to a working table of said milling machine.

7. The vise of claim 6 wherein said notches are located in marginal protruding parallel edges on said base.

8. A movable jaw for use with a base of a vise for gripping a workpiece wherein the base comprises a fixed jaw face, the movable jaw comprising:

(a) an upper jaw piece supporting a traveling nut at a crank end and forming orthogonal, chamfered faces at a moving jaw end and having edge located slots extending from said moving jaw end to said crank end and engaging left and right ways on said base, (b) a U-shaped lower jaw piece having parallel left and right legs fitting into hollow receptacles in said upper jaw piece, and having a traverse head at right angles to said left and right legs and forming a moving jaw face, (c) two adjusting screws threaded into openings in said crank end of said upper jaw piece and threadedly engaging internal tapped openings in said parallel legs; wherein (d) said orthogonal, chamfered faces on said upper jaw piece contact matching orthogonal, chamfered faces on said traverse head of said lower jaw piece thereby allowing relative motion of said upper jaw piece with respect to said lower jaw piece to be controlled by adjusting said screws, and thereby allowing said upper jaw piece to cant within said ways while said lower jaw piece remains in contact with said glide surface thereby maintaining said fixed jaw face and said moving jaw face parallel when gripping said workpiece displaced from a centerline of said vise.

9. The movable jaw of claim 8 wherein:

(a) said movable jaw is moved with respect to said base and said fixed jaw face by means of a rotatable crank with a shaft extending through an opening in a mounting block attached to said base;

(b) said shaft is operationally attached to a lead screw threaded into said traveling nut; and (c) rotation of said crank moves said movable jaw with respect to said base and said fixed jaw face attached thereto.

10. The movable jaw of claim 9 further comprising a sacrificial insert affixed to said moving jaw face, wherein said insert aids in gripping said workpiece when grasped between said moving and fixed jaw faces of said vise off center from said center line.

11. The movable jaw of claim 9 wherein said screws are periodically adjusted to compensate for wear of said ways, said edge located slots and said base thereby maintaining contact between said parallel legs and said base surface when said workpiece s gripped off center from said center line of said vise.

12. A milling machine vise for gripping a workpiece, comprising:

(a) a base comprising
  (i) a fixed jaw face supported at a fixed jaw end,
  (ii) a glide surface, and
  (iii) left and right ways bordering parallel sides of said glide surface; and (b) a movable jaw comprising
  (i) an upper jaw piece forming orthogonal, chamfered faces at a moving jaw end and having edge located slots engaging said left and right ways,
  (ii) a U-shaped lower jaw piece having parallel left and right legs fitting into hollow receptacles in said upper jaw piece, and having a traverse head at right angles to said left and right legs and forming a moving jaw face,
  (iii) one or more adjusting screws threaded into openings in said crank end of said upper jaw piece and threadedly engaging internal tapped openings in said parallel legs; wherein (c) said orthogonal, chamfered faces on said upper jaw piece contact matching orthogonal, chamfered faces on said traverse head of said lower jaw piece thereby allowing relative motion of said upper jaw piece with respect to said lower jaw piece to be controlled by adjusting said screws, and thereby allowing said upper jaw piece to cant within said ways while said lower jaw piece remains in contact with said glide surface thereby maintaining said fixed jaw face and said moving jaw face parallel when gripping said workpiece displaced from a centerline of said vise.

13. The vise of claim 12 further comprising means for controllably moving said movable jaw with respect to said fixed jaw.

14. The vise of claim 12 wherein said means for controllably moving said movable jaw with respect to said fixed jaw further comprising a rotatable crank mounted on said base and cooperating with a lead screw which is operationally threaded to said moving jaw.

15. The vise of claim 14 further comprising:

(a) a first sacrificial insert affixed to said fixed jaw face; and (b) a second sacrificial insert affixed to said moving jaw face; wherein said inserts aid in gripping said workpiece when grasped between said jaw faces off center from a center line of said vise.

16. The vise of claim 13 wherein said one or more screws are periodically adjusted to compensate for wear of said ways, said edge located slots and said glide surface thereby maintaining contact between said parallel legs and said glide surface when said workpiece s gripped off center from said center line of said vise.

17. The vise of claim 14 wherein said center line is defined by the major axis of said lead screw.

18. The vise of claim 12 further comprising notches in said base with which said vise is bolted to a working table of said milling machine.

19. The vise of claim 18 wherein said notches are located in marginal protruding parallel edges on said base.

20. The vise of claim 12 wherein said upper jaw piece further comprises:

(a) a first chamfered face
  (i) having a first and a second end, and
  (ii) fabricated perpendicular to said slots;

(b) a second chamfered face parallel to said slots and contacting said first chamfered face at said first end; and (c) a third chamfered face parallel to said slots and contacting said first chamfered face at said second end.

* * * * *